United States Patent [19]

Carlson

[11] 4,380,150

[45] Apr. 19, 1983

[54] PUMP JACK ASSEMBLY FOR WELLS

[76] Inventor: John C. Carlson, General Delivery, Salmon Arm, British Columbia, Canada, V0E 2T0

[21] Appl. No.: 119,378

[22] Filed: Feb. 7, 1980

[30] Foreign Application Priority Data

Feb. 22, 1979 [CA] Canada ..... 322062

[51] Int. Cl.[3] ..... F15B 1/02; F15B 13/02

[52] U.S. Cl. ..... 60/372; 60/415; 60/416

[58] Field of Search ..... 60/371, 372, 416, 415; 91/466

[56] References Cited

U.S. PATENT DOCUMENTS

| | | | |
|---|---|---|---|
| 2,584,127 | 2/1952 | Harcum et al. | 91/466 X |
| 2,887,846 | 5/1959 | Habenicht | 60/372 |
| 2,982,100 | 5/1961 | Sinclair | 60/372 |
| 2,990,816 | 7/1961 | Vincent | 60/372 X |
| 2,999,360 | 9/1961 | Habenicht | 60/372 |
| 3,632,234 | 1/1972 | Lake | 60/371 X |
| 3,892,165 | 7/1975 | Lioux | 60/416 X |

*Primary Examiner*—Irwin C. Cohen
*Attorney, Agent, or Firm*—Stanley G. Ade

[57] ABSTRACT

One pair of actuating piston and cylinder assemblies are operatively connected to the polish or sucker rod of the pump and are extended or retracted by hydraulic fluid. A further pair of piston and cylinder assemblies are operatively connected to the polish rod and are operatively connected on the underside thereof to an accumulator that includes an inert gas over oil with the gas being supplied under adjustable control conditions from a cylinder or source of high pressure gas so that these further pair of piston and cylinder assemblies counteract the weight of the pump system. On the downstroke, pressure is supplied to the upper sides of all four piston and cylinder assemblies with the two further piston and cylinder assemblies supporting the weight via the accumulator. The gas pressure is adjustable to support the desired proportion of the weight of the pump assembly and the oil being pumped thereby and other accumulators are provided in the circuits to cushion the shock load at either end of the stroke of the pump. Automatically operated switch valves and adjustable flow dividers control the oil flow to the piston and cylinder assemblies at either end of the stroke and the speed of the stroke respectively.

12 Claims, 4 Drawing Figures

PUMP JACK ASSEMBLY FOR WELLS

BACKGROUND OF THE INVENTION

This invention relates to power units actuated hydraulically and more particularly to hydraulically actuated fluid pumps. This apparatus is especially useful in pumping fluids from wells and in particular, in the pumping of fluids from relatively deep wells.

The majority of well pumps include a pump rod that goes down into the well and is connected at the upper end to a polish or sucker rod and includes a pump string, all of which is reciprocated vertically by suitable apparatus in order to pump the liquid from the well. At the bottom end of the pump rod string, a pump is provided including a plunger, foot valve and the necessary packing glands, etc. Pumps of this character are well known and are not shown or described in the present application.

Wells can be relatively shallow or relatively deep, frequently extending downwardly to a depth of 5,000 feet or more and the deeper the well, the greater the number of problems that are present.

These problems also increase in severity as the depth of the well increases. One of the difficulties encountered is that when the rod is at the bottom of the stroke, the weight of the rod, the weight of the oil to be lifted during the upward stroke of the rod and the frictional resistance to movement provided by the pump parts, combine to offer considerable inertia or resistance to upward movement that must be overcome by the power apparatus that reciprocates the rod so that under normal circumstances, relatively high horsepower sources of power are required.

Furthermore, in conventional pumps, in extremely viscous liquids, the full lifting force is instantaneously shifted from a downward direction to an upward direction when the rod cannot keep pace with the descent of the lifting apparatus and the magnitude of this lifting force and its instantaneous application sometimes causes an elongation of the pump rod string and in time often causes considerable wear to occur or causes parts of the pump to tear loose.

Further, in actual practice it sometimes happens that the rod string in its downward movement causes the pump plunger to impact upon the bottom of the well with sometimes injurious results to the entire apparatus as well as to the foot valve within the pump at the bottom of the well.

It has therefore been necessary to reduce the reciprocatory velocity of the pump rod string so that a greater length of time is expended in changing the direction of movement of the rod string at the upper and lower ends of its stroke. This approach is disadvantageous for at least two reasons, one being that a greater amount of time must be spent in removing a given volume of oil or fluid from a well, particularly where the viscosity of the fluid is very high and a very slow pumping cycle is present, and the other being that there is a certain amount of leakage in the foot valve which is a function of time so that if a greater time is expended in lifting the oil or other fluid, a greater amount of this oil or other fluid will be lost through leakage.

SUMMARY OF THE INVENTION

The present invention overcomes these disadvantages by providing apparatus which includes among other things, at least one counter balance fluid operator which is designed and can be adjusted to counter balance the weight of the polish or sucker rod, the drill string and the reciprocating portion of the pump together with the oil or other fluid being lifted thereby so that much less power is required from the source of power operating the down well pump.

In accordance with the invention, there is provided a pump jack assembly for wells which includes a polish or sucker rod operating a pump within the well and a source of hydraulic fluid under pressure; the improvement comprising in combination a pump actuating assembly having a lift stroke and a return stroke and including at least one fluid operator operatively connected to the polish rod, and a counter balance assembly including at least one fluid operator, also operatively connected to the polish rod, said fluid operators including a lift side and a return side, means operatively connecting the source of hydraulic fluid under pressure, to the lift side of said fluid operator of said pump actuating assembly when said pump actuating assembly is on the lift stroke, and to the return side of said fluid operators of said pump actuating assembly and said counter balance assembly when said pump actuating assembly is on the return stroke, and a fluid source having adjustable pressure and being operatively connected to the lift side of the fluid operator of said counter balance assembly. Furthermore, the lift stroke preferably has an independently infinitely variable adjusted speed control and the return stroke also has an independently infinitely variable adjusted speed control.

Another advantage of the invention is that means are provided whereby the proportion of the total weight of the assembly supported by the counter balance assembly, is adjustable within extremely close limits automatically in the case of a lowering of outer fluid level.

Yet another object of the invention is to provide a device of the character herewithin described in which the control valves are automatically operated via electrical contacts if a source of electricity is available at the well site or by mechanical means if a source of electricity is not available or if design parameters so dictate.

Yet another advantage of the present invention is to provide a device of the character herewithin described in which means may be provided to control the speed of the pumping cycle and also to control the acceleration and deceleration of the polish or sucker rod towards either end of the stroke.

A still further object of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention in which:

DESCRIPTION OF THE DRAWINGS

In the drawings like characters of reference indicate corresponding parts in the different figures.

DETAILED DESCRIPTION

Figure 2:
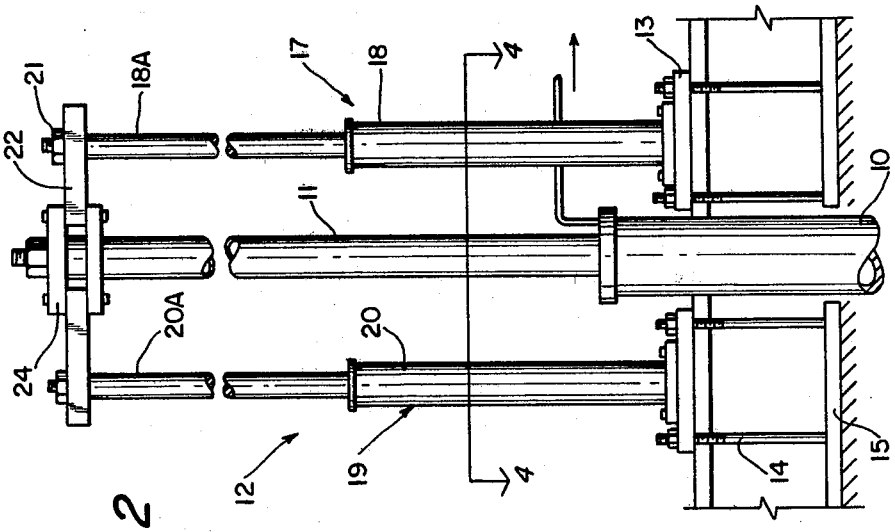
FIG. 2 is a fragmentary, partially schematic front elevation of the reciprocating portion of the invention.

Proceeding therefore to describe the invention in detail, reference should first be made to FIG. 2 which shows the upper end of a well casing 10 with a polish or sucker rod 11 extending upwardly therefrom. This polish or sucker rod extends downwardly via a pump string (not illustrated) to a conventional lift pump (not illustrated) at the bottom of the well within which the casing 10 extends. However, as all of this construction is conventional, it is not deemed necessary to illustrate or describe same further.

Means collectively designated 12 are provided to reciprocate the polish or sucker rod 11, vertically within the well casing 10. In the present embodiment, said means consists of a mounting base plate 13 secured as by bolt assemblies 14, to a base 15 surrounding the casing 10. Said mounting base plate 13 is provided with a cut-out as at 16, so that it partially surrounds the casing 10 which extends upwardly therethrough.

Figure 4:
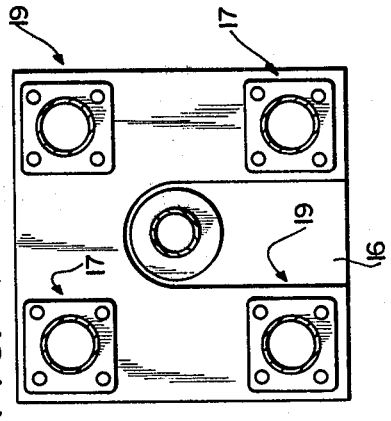
FIG. 4 is a section substantially along the lines 4—4 of FIG. 2.

A pump actuating assembly collectively designated 17 consists of at least one piston and cylinder assembly with the cylinder 18 being secured at the lower end thereof to the mounting base plate 13 and extending upwardly therefrom. In the present embodiment, a pair of such fluid actuators are provided, secured to the mounting base plate 13 in a diagonal relationship as clearly shown in FIG. 4.

Also provided is a counter balance assembly consisting of at least one piston and cylinder assembly 19 with the cylinder 20 thereof also being secured to the mounting base plate 13 and extending upwardly therefrom. In the present embodiment, a pair of such fluid operators is provided situated in diagonal relationship upon the plate 13 as clearly shown in FIG. 4. However, it will be appreciated that one or more fluid operators may be provided for the pump actuating assembly and for the counter balance assembly.

The piston rods 18A and 20A of the fluid operators 17 and 19 respectively, extend upwardly from the cylinders 18 and 20 and are secured as by nuts 21, to a lift plate 22 situated spaced above the base 13. This lift plate is also provided with a cut-out 23 through which the upper end of the polish or sucker rod 11 extends to be clamped to this lift plate by means of a clamp assembly 24 clamping the upper end of the rod 11 to this lift plate so that the lift plate reciprocates with the polish or sucker rod.

Means are provided to reciprocate the piston rods, the lift plate 22 and the sucker rod 11 so that it describes a lift stroke and a return stroke in order to operate the pump at the bottom of the well.

Figure 1:
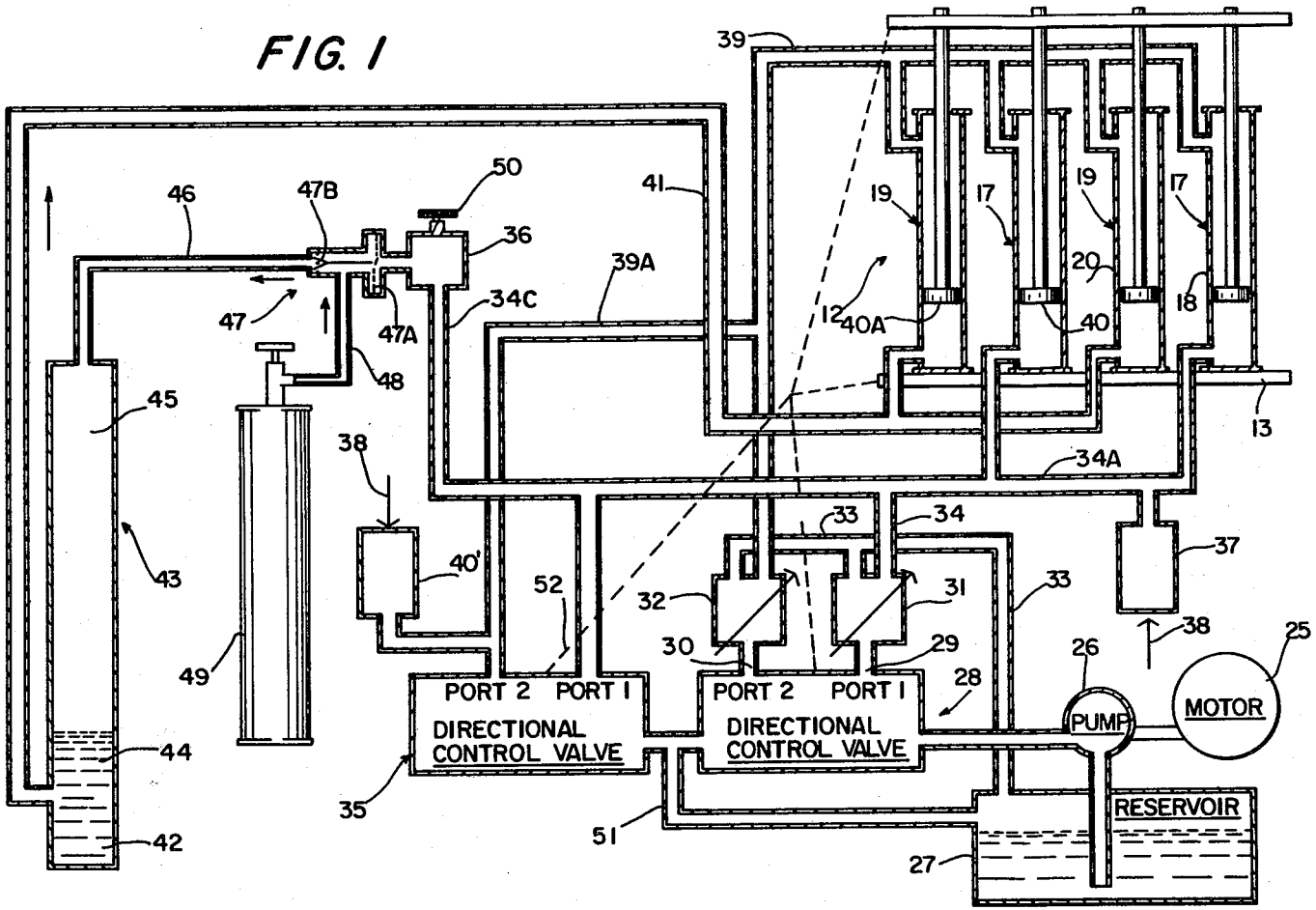
FIG. 1 is a schematic view of the invention.
Figure 3:
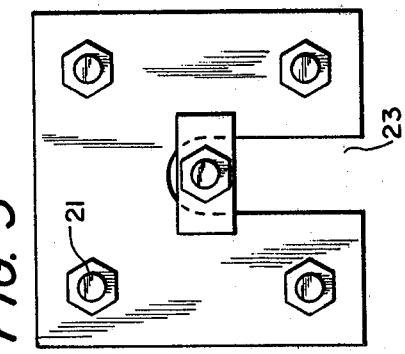
FIG. 3 is a top plan view of FIG. 2.

Reference should now be made to FIG. 1 in which reference character 25 illustrates a source of power in the form of an electric motor, if electricity is available at the well site, or a gasoline motor if electricity is not available and if design parameters prefer a gasoline motor. This motor operates a fluid pump 26 which is connected to a fluid reservoir 27 carrying a supply of hydraulic oil or fluid and in this description, the term "oil" includes all such fluids that are used for hydraulic piston and cylinder assemblies and the like.

A first directional control valve is provided collectively designated 28 and the pump 26 is operatively connected to this first directional control valve.

This control valve 28 is provided with two ports, namely port #1 shown by reference character 29 and port #2 shown by reference character 30.

A suitable shuttle valve or the like is incorporated within this control valve and as the operation of same is conventional, it is not shown or described in this application.

Conventional variable setting flow dividers 31 and 32 are connected respectively to ports #1 and #2 and these flow dividers include conduits 33 which extend to the reservoir 27 and it will be noted that both of the flow dividers are connected to a common return conduit 33.

A further conduit 34 extends from flow divider 31 to the underside or lift side of each of the fluid operators 17 constituting the pump actuating assembly. Conduit 34A shows these connections. Conduit 34 also branches into conduit 34B which in turn is connected to port #1 of a second directional control valve collectively designated 35. Branch 34B also extends to an adjustable relief valve assembly 36, the purpose of which will be hereinafter described. Also of importance is a conventional accumulator 37 connected to the conduit 34A and capable of pre-charging, if desired, as indicated by arrow 38.

Oil return conduit 39 extends from the upper or return stroke side of the pistons 40 of the fluid operators 17 and 19 and this conduit 39 is connected to the flow divider 32 which in turn is connected to port #2 of the directional control valve 28.

A branch conduit 39A extends from conduit 39 to port #2 of the other directional control valve 35. Also of note is a further conventional accumulator 40' connected to conduit 39A and being capable of pre-charging as illustrated by arrow 38.

The counter balance assemblies 19 are connected via conduits 41 on the under or lift side thereof, to the lower side 42 of an accumulator collectively designated 43. This accumulator contains fluid or oil 44 in the lower portion thereof and an inert gas under pressure in the upper portion 45 thereof and the upper portion is provided with a conduit 46 extending therefrom to a one-way high-to-low pressure regulator valve collectively designated 47. This is conventional in construction and operation and a conduit 48 extends from this valve to a source of high pressure gas such as a gas cylinder 49 which contains an inert gas under high pressure such as nitrogen. This regulator valve includes a diaphragm 47A dividing the oil from conduit 34C, from the nitrogen or other similar inert gas in line 48. A one-way valve 47B is actuated by the diaphragm 47A when the pressure of oil in conduit 34C is sufficient, thus routing gas under pressure from cylinder 49 to the accumulator 43 thereby increasing the counterbalancing effect of the fluid operator 19. Referring back to the adjustable relief valve assembly 36, this is adjusted by means of the control 50 and is adapted to operate the pressure regulator valve 47 in the usual manner, when a certain predetermined pressure is present within the conduit 34C connected to the relief valve. In other words, the pressure regulator valve 47 opens when a pressure is present within the relief valve, determined by the adjustment of this relief valve.

In operation and assuming that both the pump actuating fluid operators 17 and the counter balance fluid operators 19 are at or just beyond the fully retracted position as shown schematically in FIG. 1 under which circumstances the sucker rod 11 is also in or just beyond its lowermost position.

Motor or source of power 25 operates pump 26 and supplies oil under pressure to the directional control valve 28. In this particular position, port #2 of this valve is open to reservoir and port #1 is opened so that this fluid under pressure passes to the fluid divider 31 with some returning to the reservoir 27 via conduit 33 and the remainder passing into conduit 34 and thence to port #1 of directional control valve 35 which at this point is closed. It also passes to the underside of the pistons 40 of the fluid operators 17 and also acts upon the adjustable relief valve 36. Due to the weight of the pump assembly within the well, pressure builds up within the conduit 34 without lifting the pistons 40, until it reaches the pre-determined pressure set by the relief valve. At this point it actuates the pressure regulator valve 47 and allows the high pressure gas from cylinder 49 to charge the accumulator 43. This high pressure gas flows until sufficient pressure is present in the accumulator to counteract the major proportion of the weight of the pump string assembly and the oil within the pump string assembly so that the oil flowing from the accumulator through the conduit 41, acts on the underside of the pistons 40A of the fluid operators 19. This pressure together with the pressure acting under the pistons 40, lifts the pump assembly upwardly with the fluid operators extending towards their fullest extent, and with the speed being controlled by the adjustment of the flow divider 31.

As the pistons 40 and 40A rise within the cylinders, oil on the upper sides of these pistons is expelled via conduit 39 through branch 39A to port #2 of the control valve 35 which is open at this point and connected to the reservoir via the return line 51. When the assembly reaches the fully extended position, means are provided to reverse the position of valves 28 and 35 so that port #1 of valve 28 is open to reservoir and port #2 is open, and port #2 of valve 35 is closed and port #1 is open to reservoir. This changes the direction of the sucker rod and starts moving it downwardly. Any shock is taken up by the aforementioned accumulator 40'.

With the valving shifted as aforesaid, pump 26 supplies fluid under pressure to port #2 of valve 28 and hence to flow divider 32 with some passing through conduit 33 back to the reservoir. The remainder passes through conduit 39 to the upper side of all of the piston and cylinder assemblies 17 and 19 and commences moving them downwardly assisted by the weight of the sucker rod and pump assembly and oil contained therein. This downward movement is controlled due to the fact that pistons 40A are now driving fluid back through conduit 41 through the accumulator 43 against pressure of the gas within the upper portion 45 which cannot escape due to the one-way characteristic of pressure regulator valve 47. Fluid on the underside of pistons 40 flows through conduit 34B to port #1 of the control valve 35 which is now connected to the return line 51 to the reservoir.

When the sucker rod reaches its lowermost position, means are provided to once again switch the valves 28 and 35 so that the process is repeated and any shock is taken up by the aforementioned accumulator 37.

At either end of the pumping stroke, means connected to the lift plate 22 or associated reciprocating structure, operates valves 28 and 35 as indicated by the dotted line 52. This means may either take the form of microswitches operating solenoids (not illustrated) or, if electricity is not available, by mechanical linkage (not illustrated). Both examples are exemplified by the dotted line 52 extending between valves 28 and 35 and the lift plate 22.

Any gas within the upper portion of accumulator 45 that might escape or be absorbed by the fluid within the lower portion of the accumulator, is made up from the high pressure gas supply 49 through pressure regulator 47 actuated by the relief valve assembly 36.

By adjusting the pressure of the gas within the accumulator 43, the differential between the weight of the pump string and fluid, together with any frictional losses may be controlled and may be as little as a few pounds per square inch so that the source of power 25 may be relatively small thus showing extensive savings in power requirements as it is the weight of the assembly moving downwardly which assists in recompressing the gas within accumulator 43.

It should also be noted that the area of the pistons 40 and 40A are less on the upper side than on the under side due to the presence within the cylinders of the piston rods.

Summarizing, on the upstroke, the pistons 40A are moved upwardly by adjustable pressure from accumulator 43 acting upon the underside thereof and the speed of the pistons 40 is controlled by adjustment of fluid volume from flow divider 31 acting upon the underside of these pistons 40.

The speed of the downstroke of pistons 40 and 40A is by fluid volume acting upon the uppersides thereof and controlled or varied by flow divider 32.

The pressure in the counter balance assemblies 19 dictates the ease with which the upstroke is completed and the volume of fluid delivered via the flow dividers, dictates the speed with which both up and down strokes is independently accomplished.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. In a pump jack assembly for wells which include a polish rod operating a pump within the well and a source of hydraulic fluid under pressure including a fluid reservoir; the improvement comprising in combination a separate pump actuating assembly having a lift stroke and a return stroke and including at least one fluid operator operatively connected to the polish rod, and a separate counter balance assembly including at least one fluid operator, also operatively connected to the polish rod, said fluid operators including a lift side and a return side, means operatively connecting the source of hydraulic fluid under pressure, to the lift side of said fluid operator of said pump actuating assembly when said pump actuating assembly is on the lift stroke, and to the return side of said fluid operators of said pump actuating assembly and said counter balance assembly when said pump actuating assembly is on the return stroke, said connecting means being responsive to the position of said pump actuating assembly to effect a cycling operation of said pump jack assembly, and a fluid source having means to adjust the pressure thereof and being operatively connected to the lift side of the fluid operator of said counter balance assembly, said fluid source having adjustable pressure including an accumulator having a liquid in the lower portion thereof and gas under pressure in the upper portion thereof, said liquid being operatively connected to the lift side of the fluid operator of said counter balance assembly, a source of high pressure gas, a one-way high-to-low pressure regulator valve between said source and the upper portion of said last mentioned accumulator, and adjustable means operatively connected to the hydraulic pressure acting on the lift side of the fluid operator of said pump actuating assembly and said regulating valve for operating said regulating valve.

2. The invention according to claim 1 which includes an accumulator in circuit with the fluid operator of said pump actuating assembly on the lift side thereof, and a further accumulator in circuit with said fluid operator of said pump actuating assembly on the return side thereof.

3. The invention according to claim 1 in which said means operatively connecting the source of hydraulic fluid to the lift side of said fluid operator of said pump actuating assembly includes a first directional control valve operatively connected between said source of fluid under pressure and said fluid operator of said pump actuating assembly, a second directional control valve also operatively connected between said source of hydraulic fluid under pressure and the return side of the fluid operator of said counter balance assembly and the return side of the pump actuating assembly and means to actuate said first and second directional control valves at the end of the lift and return strokes of said pump actuating assembly.

4. The invention according to claim 2 in which said means operatively connecting the source of hydraulic fluid to the lift side of said fluid operator of said pump actuating assembly includes a first directional control valve operatively connected between said source of fluid under pressure and said fluid operator of said pump actuating assembly, a second directional control valve also operatively connected between said source of hydraulic fluid under pressure and the return side of the fluid operator of said counter balance assembly and the return side of the pump actuating assembly and means to actuate said first and second directional control valves at the end of the lift and return strokes of said pump actuating assembly.

5. The invention according to claim 3 which includes an adjustable flow divider operatively connected with said first directional control valve on the lift circuit of said pump actuating assembly and a further flow divider operatively connected with said first directional control valve on the return circuit of said pump actuating assembly and said counterbalance assembly.

6. The invention according to claim 4 which includes an adjustable flow divider operatively connected with said first directional control valve on the lift circuit of said pump actuating assembly and a further flow divider operatively connected with said first directional control valve on the return circuit of said pump actuating assembly and said counterbalance assembly.

7. The invention according to claims 1 or 2 which includes a mounting base for the fluid operators of said pump actuating assembly and said counter balance assembly and a lift plate for said polish rod and attachable thereto, the movable portion of said piston and cylinder assemblies being connected to said lift plate.

8. The invention according to claims 3, 4 or 5 which includes a mounting base for the fluid operators of said pump actuating assembly and said counter balance assembly and a lift plate for said polish rod and attachable thereto, the movable portion of said piston and cylinder assemblies being connected to said lift plate, said means to actuate said first and second directional control valves being operatively connected to said lift plate.

9. The invention according to claim 6 which includes a mounting base for the fluid operators of said pump actuating assembly and said counter balance assembly and a lift plate for said polish rod and attachable thereto, the movable portion of said piston and cylinder assemblies being connected to said lift plate, said means to actuate said first and second directional control valves being operatively connected to said lift plate.

10. The invention according to claims 3 or 4 which includes means operatively connected to said assembly to infinitely and variably control the speed of the return stroke of said pump assembly, said last mentioned means including an adjustable flow divider operatively connected to said first directional control valve, the output of said flow divider including a first output and a second output, said first output being operatively connected to the return side of said pump acuating assembly and of said counterbalance assembly, and to said regulator valve, said second output being connected to the fluid reservoir, the adjustment of said flow divider infinitely varying the proportion of fluid between said first and second outputs and hence the speed of the return stroke of said pump assembly.

11. The invention according to claims 3 or 4 in which said first directional control valve includes means operatively connected thereto, to infinitely and variably control the speed of the lift stroke of said pump actuating assembly, said last mentioned means including adjustable flow divider operatively connected to said first directional control valve, said flow divider having first and second outputs, said first output being operatively connected to the lift side of said pump actuating assembly and to said regulator valve, said second output being operatively connected to the fluid reservoir, the adjustment of said flow divider infinitely varying the proportion of fluid between said first and second outputs and hence the speed of the lift stroke of said pump actuating assembly.

12. The invention according to claim 10 in which said first directional control valve includes means operatively connected thereto to infinitely and variably control the speed of the lift stroke of said pump actuating assembly, said last mentioned means including a further adjustable flow divider operatively connected to said first directional control valve, said further flow divider having first and second outputs, said first output being operatively connected to the lift side of said pump actuating assembly and to said regulator valve, said second output being operatively connected to the fluid reservoir, the adjustment of said further flow divider infinitely varying the proportion of fluid between said first and second outputs and hence the speed of the lift stroke of said pump actuating assembly.

* * * * *